US008811124B2

(12) United States Patent
Courvoisier

(10) Patent No.: US 8,811,124 B2
(45) Date of Patent: Aug. 19, 2014

(54) DATE SYSTEM FOR A TIMEPIECE

(75) Inventor: Raphael Courvoisier, Montmollin (CH)

(73) Assignee: Montres Breguet S.A., L'Abbaye (CH)

( * ) Notice: Subject to any disclaimer, the term of this patent is extended or adjusted under 35 U.S.C. 154(b) by 326 days.

(21) Appl. No.: 13/497,956

(22) PCT Filed: Sep. 29, 2010

(86) PCT No.: PCT/EP2010/064489
§ 371 (c)(1),
(2), (4) Date: Mar. 23, 2012

(87) PCT Pub. No.: WO2011/045181
PCT Pub. Date: Apr. 21, 2011

(65) Prior Publication Data

US 2012/0195169 A1 Aug. 2, 2012

(30) Foreign Application Priority Data

Oct. 12, 2009 (EP) ..... 09172787

(51) Int. Cl.
*G04B 19/253* (2006.01)

(52) U.S. Cl.
USPC ..... 368/34; 368/38

(58) Field of Classification Search
CPC ..... G04B 19/24–19/24306; G04B 19/247–19/25346
USPC ..... 368/28, 31, 34, 35, 37, 38
See application file for complete search history.

(56) References Cited

U.S. PATENT DOCUMENTS

| | | | | |
|---|---|---|---|---|
| 3,240,006 | A * | 3/1966 | Reese | 368/38 |
| 3,427,798 | A | 2/1969 | Rogers et al. | |
| 7,258,481 | B2 * | 8/2007 | Zachmann | 368/185 |
| 7,269,102 | B2 * | 9/2007 | Hirano et al. | 368/28 |
| 7,924,657 | B2 * | 4/2011 | Liebowitz | 368/327 |
| 2008/0049557 | A1 | 2/2008 | Yang | |
| 2008/0144444 | A1 | 6/2008 | Mahler et al. | |

FOREIGN PATENT DOCUMENTS

| | | |
|---|---|---|
| CH | 296 400 | 2/1954 |
| CH | 615 556 | 2/1980 |
| EP | 1 933 210 | 6/2008 |
| FR | 815 127 | 7/1937 |
| GB | 1 205 962 | 9/1970 |

OTHER PUBLICATIONS

International Search Report Issued Feb. 1, 2011 in PCT/EP10/64489 Filed Sep. 29, 2010.

* cited by examiner

*Primary Examiner* — Amy Cohen Johnson
*Assistant Examiner* — Jason Collins
(74) *Attorney, Agent, or Firm* — Oblon, Spivak, McClelland, Maier & Neustadt, L.L.P.

(57) ABSTRACT

The invention relates to a timepiece (1) including a timepiece movement (5) comprising a time measuring system (11) for displaying the time, and a date system (13) connected to said time measuring system for displaying the date. According to the invention, the date system (13) includes a display of the continuously moving type and a correction device (12) which can correct said date display at any time, by a predetermined step (A, B), while maintaining the relationship of said continuous movement relative to that of said time during the correction operation.
The invention concerns the field of date displays.

8 Claims, 3 Drawing Sheets

DATE SYSTEM FOR A TIMEPIECE

CROSS-REFERENCE TO PRIORITY APPLICATIONS

This is a National Phase Application in the United States of International Patent Application PCT/EP2010/064489 filed Sep. 29, 2010, which claims priority on European Patent Application No. 09172787.5 of Oct. 12, 2009. The entire disclosures of the above patent applications are hereby incorporated by reference.

FIELD OF THE INVENTION

The invention relates to a date system for a timepiece and, more specifically, to a system of this type comprising a device for correcting in one day or half day steps.

BACKGROUND OF THE INVENTION

Date systems are widespread in the field of horology. The best known systems concern the display of the day of the month. Mechanisms currently used for displaying the date are dragging, instantaneous or semi-instantaneous devices using a hand or a disc. All of these current mechanisms have to store energy for a certain period of time in order to supply energy for the date change around midnight.

This operating mode causes variations in the amplitude of the balance which are detrimental to the working of the timepiece during said storage phases. Moreover, this operating mode leads to accelerations and shocks for the hand or disc which makes the adjustment of the date systems sensitive. Finally, these systems make it difficult to correct the date close to the date change and require a safety device to be used to avoid damage.

SUMMARY OF THE INVENTION

It is an object of the present invention to overcome all of part of the aforecited drawbacks by proposing a date system whose energy consumption is substantially constant during operation and which uses a simplified correction device.

The invention therefore relates to a timepiece including a timepiece movement comprising a time measuring system for displaying the time, a date system connected to said time measuring system for displaying the date, characterized in that the date system includes a continuously moving display and a correction device which can correct said date display at any time, according to a predetermined step, while maintaining the relationship of said continuous movement relative to the movement of said time during the correction operation.

It is thus clear that the date is no longer changed around midnight, but continuously, to achieve constant energy consumption and to make the movements of the balance substantially constant. Moreover, this date system includes fewer parts and is thus simpler to construct even with its correction device.

In accordance with other advantageous features of the invention:

said predetermined step is equal to 12 or 24 hours;

the date system includes a gear train comprising a driving wheel permanently connected to the time measuring system by a reduction gear so that said driving wheel imparts one complete revolution in 31 days;

the gear train of the date system is meshed with the hour wheel of the time measuring system;

the gear train further includes a driven wheel driving the moving part of the date display, and the correction device includes an intermediate wheel connected to the driven wheel and a connecting means, so that said driving wheel drives the driven wheel when no correction operation is being performed;

the connecting means is formed by a star toothing mounted on the driven wheel and associated with a jumper spring integral with or fixed to the driving wheel so that, when the intermediate wheel is actuated, the relative movement between the driven wheel and the driving wheel does not disturb the relationship of said continuous movement of the driving wheel relative to the movement of said time;

the star toothing comprises 62 teeth for said 12 hour step and 31 teeth for the 24 hour step;

the date display is of the type with a hand or a disc;

the date system displays at least the day of the month.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
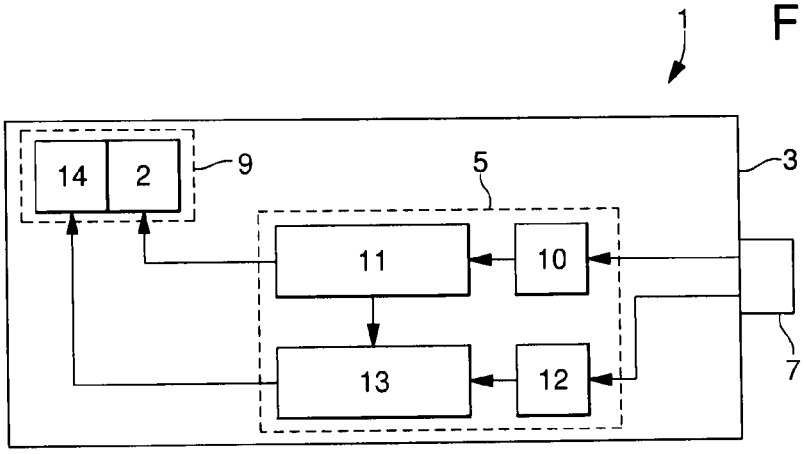
FIG. 1 is a schematic diagram of a timepiece according to the invention.

The example illustrated in FIG. 1 shows a schematic diagram of a timepiece 1 according to the invention. The timepiece includes a case 3 inside which there is mounted a mechanical movement 5, controlled by at least one control member 7, which preferably projects from case 3 and is for correcting the display device 9 of timepiece 1.

Timepiece movement 5 includes a time measuring system 11 and a date system 13. Time measuring system 11 is for displaying the time, i.e. for driving the moving parts of time display means 2. In the example illustrated in FIGS. 1 and 2, display device 9 of timepiece 1 includes time display means 2 of the type with moving hands 4, 6 and an hour circle 8. Time measuring system 11 also includes a correction device 10 allowing moving parts 4, 6 of display means 2 to be modified by actuating control member 7.

Date system 13 is for displaying at least the day of the month, i.e. for driving the moving parts of date display means 14. In the example illustrated in FIGS. 1 and 2, display device 9 of timepiece 1 includes date display means 14 of the type with a moving hand 16 and a date circle 18. Date system 13 also includes a correction device 12 allowing said moving parts 16 of display means 14 to be modified, preferably also by actuating control member 7. Control member 7 thus preferably controls both correction devices 10 and 12 of timepiece movement 5.

Figure 2:
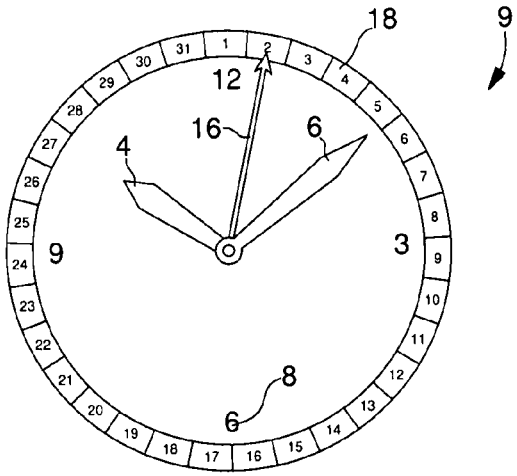
FIG. 2 is a diagram of a timepiece display according to the invention.
Figure 3:
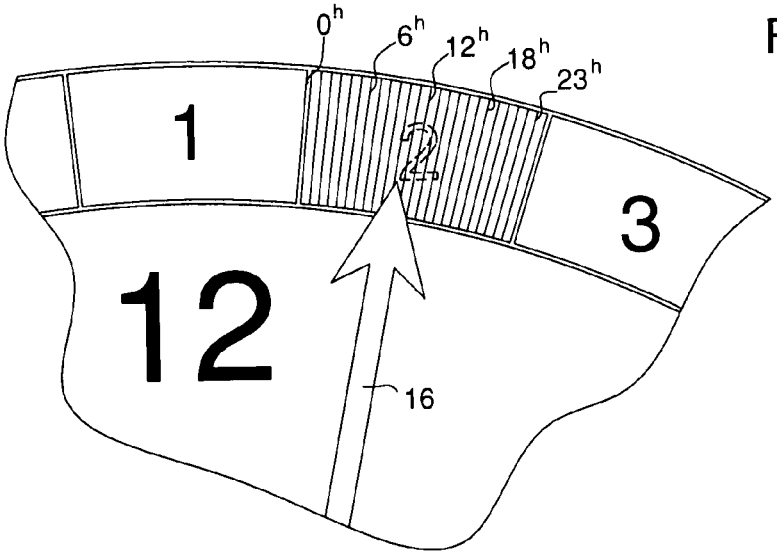
FIG. 3 is an enlarged view of FIG. 2.

Advantageously according to the invention, date system 13 includes continuously moving display means 14. As illustrated in FIGS. 2 and 3, this means that hand 16 does not move in successive jumps but continuously, which shows the advance of the day. Thus, it is immediately possible to see whether time display means 2 is displaying the morning time or the afternoon time as shown by the divisions of the second date display in FIG. 3. This also means that the energy consumption of date system 13 is substantially constant during operation of timepiece 1, thereby avoiding variations in the amplitude of the balance of time measuring system 11.

Moreover, date system 13 preferably includes a correction device 12 which can correct display means 14, in a predetermined 12 or 24 hour step, i.e. by a day or half a day, and at any time of the day, i.e. including around midnight, while maintaining the relationship of continuous movement relative to the movement of time during a correction operation.

Figure 4:
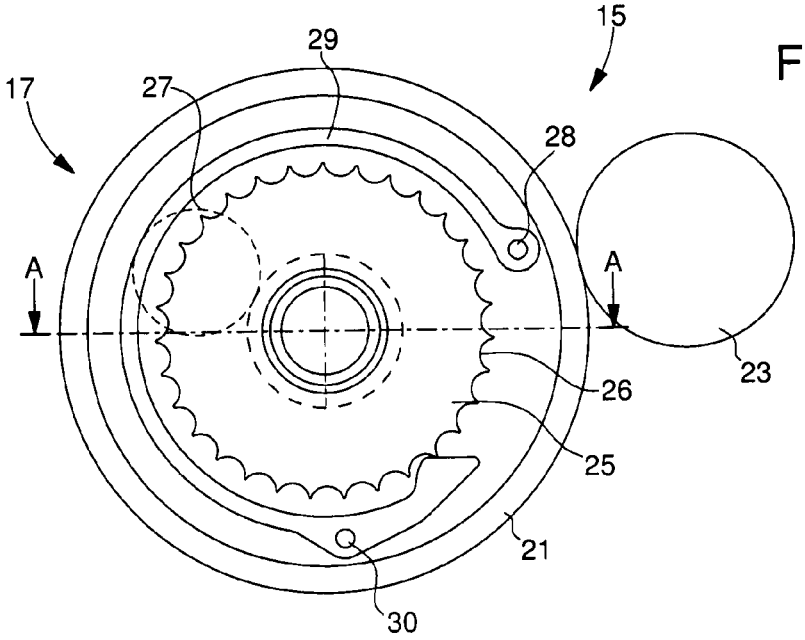
FIG. 4 is a view of part of a date system according to the invention.
Figure 5:
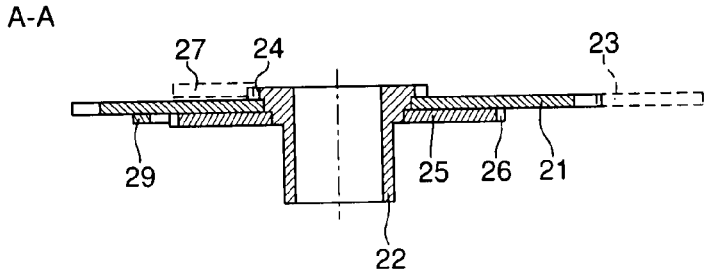
FIG. 5 is a view of cross-section A-A of FIG. 4.

In order to achieve this, date system 13 mainly includes a gear train 15 and its correction device 12, and a connecting means 17. As illustrated in FIGS. 4 and 5, gear train 15 includes a driving wheel 21, permanently connected to time measuring system 11 by a reduction gear 23, so that driving wheel 21 imparts one complete revolution in 31 days. Preferably, gear train 15 of date system 13 is meshed with the hour wheel (not shown) of time measuring system 11.

In the example illustrated in FIGS. 4 and 5, gear train 15 also includes a driven wheel 25 for driving the moving part 16 of date display means 14 via a tubular portion 22. It is thus clear that driven wheel 25 is fixedly mounted on the periphery of tubular portion 22.

Correction device 12 of date system 13 includes an intermediate wheel 27 connected to driven wheel 25 via a pinion 24 integral with tubular portion 22. Correction device 12 also includes a connecting means 17 which is inserted between driving wheel 21 and driven wheel 25 in order to maintain the relationship of continuous movement relative to that of the time during correction operations but also so that driving wheel 21 drives driven wheel 25 when no said correction operations are being performed.

Preferably, as illustrated in FIGS. 4 and 5, connecting means 17 is formed by a star toothing 26 mounted on driven wheel 25 and associated with a jumper spring 29 integral with driving wheel 21, so that, when intermediate wheel 27 is actuated by control member 7, the relative movement between driven wheel 25 and driving wheel 21 does not disturb the relationship of said continuous movement of driving wheel 21 relative to that of said time. It is thus clear that correction device 12 avoids uncoupling the date system 13 relative to time measuring system 11, which prevents any discrepancy between the advance of hand 16 of display means 14 and that of hands 4, 6 of display means 2. Consequently, advantageously according to the invention, display device 9 is always synchronised.

Figure 6:
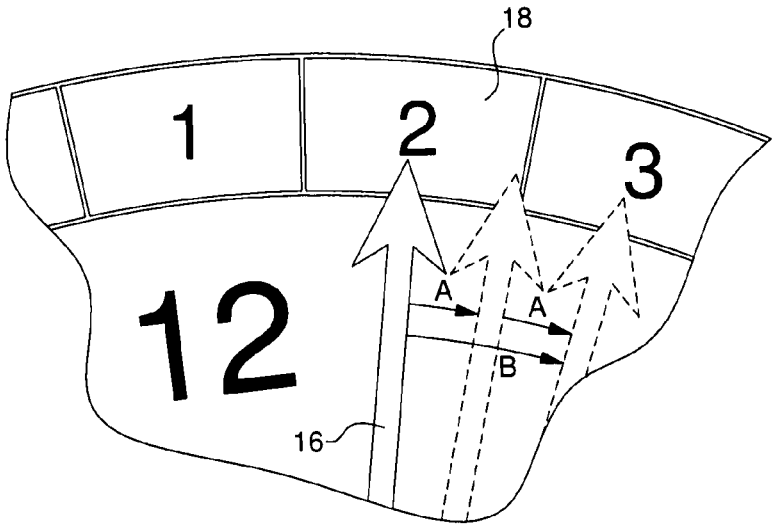
FIG. 6 is a similar diagram to FIG. 3 showing correction operations according to the invention.

Moreover, advantageously according to the invention, the date can be changed in a predetermined 12 (arrow A) or 24 hours (arrow B) step as illustrated in FIG. 6, i.e. by a day or half a day, simply by changing the number of teeth of toothing 26. Thus, if a correction step of a half day (arrow A) is required for device 12, toothing 26 will include 62 teeth and, as illustrated in FIG. 4, if a correction step of one day (arrow B) is required for correction device 12, toothing 26 will have 31 teeth.

The operation of date system 13 will now be explained. Date system 13 operates in two modes which can advantageously operate together.

There is a first permanent date display mode, and a second date display correction mode, which can operate at the same time. In both modes, it is important to note that date system 13 and time measuring system 11 are permanently connected so as to keep a constant relationship between the continuous movement of date display means 14 and that of time display means 2, including during the change into correction mode.

In display mode, the time measuring system 11 supplies, preferably by the hour wheel thereof, via reduction gear 23, the energy necessary for driving wheel 21 to rotate in 31 days. Jumper spring 29 is mounted integral with driving wheel 21 via an arbour 28 and via a pivot 30. Drive wheel 21 thus continuously drives the whole of jumper spring 29 in rotation. The end of jumper spring 29 in contact with toothing 26 of driven wheel 25 will also drive said toothing in the same continuous rotation. Since tubular portion 22 is integral with or fixed to the driven portion, it will also impart this continuous rotation and, incidentally, an inverse rotation on intermediate wheel 27. As the moving portions 16 of display means 14 are integral with tubular portion 22, they make said continuous rotation, indicating the advance of the day for each date consecutively.

To change into correction mode, control member 7 is actuated so as to act on correction device 12. Control member 7 will then actuate intermediate wheel 27. The movement of said wheel 27, transmitted by pinion 24, then by tubular portion 22 and finally by driven wheel 25, will force connecting means 17 to uncouple so as to allow a relative movement between driven wheel 25 and driving wheel 21, in order to correct display means 14, integral with or fixed to driven wheel 25, without affecting the continuous rotation of driving wheel 21 of the display mode. Advantageously, in the example illustrated in FIG. 4, the movement of intermediate wheel 27 forces jumper spring 29 to be moved away by toothing 26 moving with driven wheel 25.

As explained hereinbefore, advantageously, depending on the number of teeth of toothing 26, each tooth passed by jumper spring 29 makes a predetermined correction step of 12 or 24 hours, as illustrated in FIG. 6, i.e. by a day (arrow B) or half a day (arrow A). Then by blocking control member 7, connecting means 17 elastically readjusts the advance of the date relative to that of the time, i.e. the orientation of driven wheel 25 relative to that of driving wheel 21.

Of course, this invention is not limited to the illustrated example but is capable of various variants and alterations that will appear to those skilled in the art.

Figure 7:
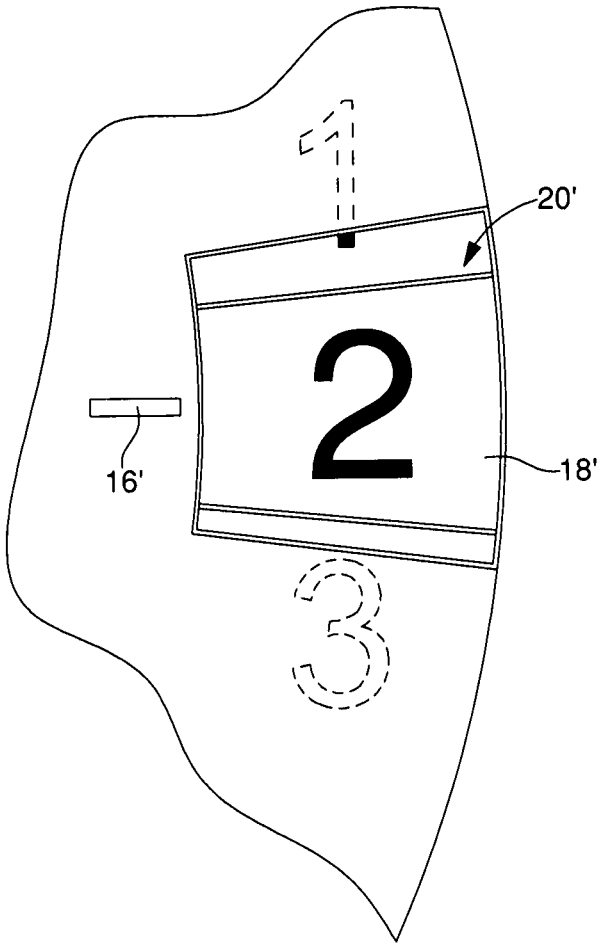
FIG. 7 is a partial diagram of a timepiece display according to a variant of the invention.

In particular, as illustrated in FIG. 7, it is possible to envisage replacing the date display means 14 with moving hand 16 and date circle 18 by other means with a fixed index 16' and a moving date circle 18', for example by using an aperture 20', without losing the advantages of the invention.

Control member 7 of correction device 12 of date system 13 may not be the same as for correction device 10 of time measuring system 11 and may equally well be a push-piece or a crown.

Connecting means 17 is not limited to a means with a star toothing 26 and jumper spring 29 and may be replaced, for example, by a connecting means with a Maltese cross and correction finger.

Finally, date system 13 is not limited to the display of the date. Other indications, such as, for example, the day, the month, the year, the number of the week and/or the moon phase may also be displayed.

The invention claimed is:

1. A timepiece, comprising:

a timepiece movement including a time measuring system for displaying the time, a date system connected to said time measuring system for displaying the date, wherein the date system includes a continuously moving type display and a correction device which can correct said date display at any time, in a step of 12 hours, while maintaining the relationship of said continuous movement relative to the movement of said time during the correction operation.

2. The timepiece according to claim 1, wherein the date system includes a gear train comprising a driving wheel permanently connected to the time measuring system by a reduction gear so that said driving wheel imparts one complete rotation in 31 days.

3. The timepiece according to claim 2, wherein the gear train of the date system is meshed with the hour wheel of the time measuring system.

4. The timepiece according to claim 2, wherein the gear train further comprises a driven wheel driving the mobile part of the date display, the correction device comprising an intermediate wheel connected to the driven wheel and a connecting means so that said driving wheel drives the driven wheel when no correction operation is being performed.

5. The timepiece according to claim 4, wherein the connecting means is formed by a toothing of the star wheel type with 62 teeth mounted on the driven wheel and associated with a jumper spring integral with the driving wheel so that, when the intermediate wheel is actuated, the relative movement between the driven wheel and the driving wheel does not disturb the relationship of said continuous movement of the driving wheel relative to the movement of said time.

6. The timepiece according to claim 1, wherein the date display is of the type with a hand.

7. The timepiece according to claim 1, wherein the date display is of the type with a disc.

8. The timepiece according to claim 1, wherein the date system displays at least the day of the month.

* * * * *